United States Patent [19]

Nazmy

[11] Patent Number: 4,820,354

[45] Date of Patent: Apr. 11, 1989

[54] METHOD FOR PRODUCING A WORKPIECE FROM A CORROSION- AND OXIDATION-RESISTANT NI/AL/SI/B ALLOY

[75] Inventor: Mohamed Nazmy, Fislisbach, Switzerland

[73] Assignee: BBC Brown Boveri AG, Baden, Switzerland

[21] Appl. No.: 86,781

[22] Filed: Aug. 19, 1987

[30] Foreign Application Priority Data

Sep. 2, 1986 [CH] Switzerland ..... 3517/86

[51] Int. Cl.[4] ..... C22F 1/10

[52] U.S. Cl. ..... 148/2; 148/11.5 N

[58] Field of Search ..... 148/2, 11.5 N

[56] References Cited

FOREIGN PATENT DOCUMENTS 0087183 1/1983 European Pat. Off. .
0175130 8/1985 European Pat. Off. .
2037322 7/1980 United Kingdom .

OTHER PUBLICATIONS

"Nickel Aluminides for Structural Use", by C. T. Liu et al; Journal of Metals, May 1986.

"Alloying Behaviour of $Ni_3Al$, $Ni_3Ga_3$, $Ni_3Si$ and $Ni_3Ge$", by Shouichi Ochiai et al; Acta Metall, vol. 32, No. 2, pp. 289–298, 1984.

"The Role of Silicon in Corrosion-Resistant High Temperature Coatings", by H. W. Grunling et al; Thin Solid Films, 95 (1982), 3–20, Metallurgical and Protective Coatings.

*Primary Examiner*—R. Dean

*Attorney, Agent, or Firm*—Oblon, Fisher, Spivak, McClelland & Maier

[57] ABSTRACT

A workpiece produced from a corrosion- and oxidation-resistant Ni/Al/Si/B alloy, which possesses simultaneously good high-temperature strength and high ductility, is produced by casting an alloy containing Al=12 to 23 atom-%,
Si=1 to 12 atom-%,
B=0.1 to 2 atom-%, with
Al+Si+B being=24 atom-%, and
Ni=remainder into a cast ingot, heat treating at 1,100° C./60 h in argon and subsequent isothermal forging between 1,050° and 1,150° C. until a deformation of $\epsilon=1.6$ is reached at a deformation rate of $\epsilon=6\times10^{-5}s^{-1}$, where $$\epsilon = \left| \ln \frac{h_o}{h_f} \right|$$

with $h_o$=original height of the workpiece,
$h_f$=height of the workpiece after deformation.

5 Claims, No Drawings

METHOD FOR PRODUCING A WORKPIECE FROM A CORROSION- AND OXIDATION-RESISTANT NI/AL/SI/B ALLOY

TECHNICAL FIELD

Alloys based on the known intermetallic compound $Ni_3Al$ with good high-temperature strength in the medium temperature range from 500° to 700° C. Relatively low density of approximately 7.3 g/cm$^3$. Improvement of the properties by adding silicon and boron.

The invention relates to the melting and casting of alloys based on the intermetallic compound $Ni_3Al$ modified with further additives and the further thermal and thermomechanical processing of the latter into process-compatible, useful workpieces with adequate corrosion-resistance and ductility.

In particular, it relates to a method for producing a workpiece from a corrosion- and oxidation-resistant Ni/Al/Si/B alloy.

PRIOR ART

The intermetallic compound $Ni_3Al$ has some interesting properties which make it appear attractive as a constructional material in the medium temperature range. Nevertheless, an obstacle to its industrial usability in the existing form in its brittleness and its inadequate corrosion resistance. It is true that the former can be improved by additions of boron, in which case higher strength figures are also achieved (c.f. C. T. Liu et al, "Nickel Aluminides for structural use", Journal of Metals, May 1986, pp. 19–21). Nevertheless, even using high cooling rates in the production of strips, this method has not resulted in any practically usable results.

The corrosion- and oxidation-resistance of such alloys based on $Ni_3Al$ can be improved by additions of silicon or chromium (c.f. M. W. Grühling and R. Bauer, "The role of silicon in corrosion resistant high temperature coatings", Thin Films, Vol. 95, 1982, pp. 3–20). In general, the addition of silicon to the alloy is a more practical method than that of chromium, since the intermetallic compound $Ni_3Si$ produced at the same time is completely miscible in $Ni_3Al$. Isomorphous states are therefore involved and no further, undesirable phases are formed (c.f. Shouichi Ochiai et al, "Alloying behaviour of $Ni_3Al$, $Ni_3Ga$, $Ni_3Si$ and $Ni_3Ce$", Acta Met. vol. 32, No. 2, p 289, 1984).

In general, the properties of these known modified $Ni_3Al$ materials still do not satisfy the technical requirements required to produce usable workpieces therefrom.

There is therefore a considerable need to find methods which make the technical usability of alloys based on $Ni_3Al$ possible.

DESCRIPTION OF THE INVENTION

The invention is based on the object of providing a method for producing a workpiece from an Ni/Al/Si/B alloy which contains $Ni_3Al$ as chief constituent, which method yields products of simultaneously high corrosion- and oxidation-resistance and good high-temperature strength as well as high ductility.

This object is achieved by the method mentioned in the introduction, wherein an alloy containing 12 to 23 atom-% Al,
1 to 12 atom-% Si, 0.1 to 2 atom-% B, with
Al+Si+B being=24 atom-%, and
remainder Ni is melted in a vacuum induction furnace and cast into an ingot which is then annealed at a temperature of 1,100° C. for 60 h in an argon atmosphere and cooled, and its casting skin and scale layer are removed mechanically, whereupon the processed ingot is inserted into a soft steel capsule and the latter is sealed, and wherein the whole is isothermally deformed in the temperature range between 1,050° and 1,150° C. with a deformation rate of $\epsilon=6\times10^{-5}\ s^{-1}$ until a deformation of $\epsilon=1.6$ is reached, where $$\epsilon = \left|\ln\frac{h_o}{h}\right|$$

$h_o$=original height of the workpiece,
h=height of the workpiece after deformation.

METHOD OF IMPLEMENTING THE INVENTION

The invention is explained on the basis of the exemplary embodiment below.

Exemplary Embodiment I

An alloy of the following composition was melted in vacuo in an induction furnace:

Al=12 atom-%,
Si=11 atom %,
B=1 atom-%
Ni=remainder (76 atom-%).

The melt was cast into ingots with a diameter of approximately 60 mm and a height of approximately 60 mm. The ingots were then subjected to a heat treatment at a temperature of 1,100° C. for 60 h in an argon atmosphere. After the heat treatment, the casting skin was removed mechanically by turning off a surface layer approximately 1 mm thick. The cylindrical ingots were then inserted into suitable capsules made of soft carbon steel and the latter were sealed by welding. The encapsulated workpieces were then isothermally forged at a temperature of 1,100° C. The deformation consisted in a setdown until a deformation of $\epsilon=1.6$ was reached, where $$\epsilon = \left|\ln\frac{h_o}{h_f}\right|$$

with $h_o$=original height of the workpiece,
$h_f$=height of the workpiece after deformation.

The deformation rate $\epsilon$ at the beginning of the forging process was $6\times10^{-5}\ s^{-1}$. The pressing forces required for the setdown were relatively low. In the present case they were approximately 500 kN, which corresponded to an initial pressure of approximately 200 MPa.

This example demonstrated the excellent deformability of the pretreated material but the decrease in height achieved with freedom from cracking during the setdown was approximately 80%.

Exemplary Embodiment II

An alloy of the following composition was melted in the manner specified in Example I:

Al=18 atom-%,

Si=5.55 atom-%,
B=0.45 atom-%,
Ni=remainder.

The melt was cast into prismatic rolling ingots measuring 100 mm×80 mm×20 mm. These were first heat treated and the casting skin was removed mechanically. The ingots were then cold-rolled. The decrease in height (=cross-section decrease) was approximately 40%. No cracks of any kind could be detected in the rolled semifinished product, which is evidence of the excellent ductility of the material.

The invention is not limited to the exemplary embodiments.

The alloy can in principle have the following composition:

Al=12 to 23 atom-%,
Si=1 to 12 atom-%,
B=0.1 to 2 atom-%, with
Al+Si+B being=24 atom-%,
Ni=remainder.

The workpiece can be subjected after the heat treatment or after the isothermal forging to a cold forming process with a cross-section decrease of up to 40%. The latter may, for example, consist in a cold rolling.

The isothermal forging process can be carried out on a forging in a manner such that the workpiece finally has the form of a gas turbine blade. This is very important since such shapes can, as a rule, be achieved only with difficulty without incipient cracking.

I claim:

1. A method for producing a workpiece from a corrosion- and oxidation-resistant Ni/Al/Si/B alloy, wherein an alloy containing consisting essentially of Al=12 to 23 atom-%,
Si=1 to 12 atom-%,
B=0.1 to 2 atom-%, with
Al+Si+B being=24 atom-%, and
Ni=remainder is melted in a vacuum induction furnace and cast into an ingot which is then annealed at a temperature of 1,100° C. for 60 h in an argon atmosphere and cooled, and its casting skin and scale layer are removed mechanically, whereupon the processed ingot is inserted into a soft steel capsule and the latter is sealed, and wherein the whole is isothermally deformed in the temperature range between 1,050° and 1,150° C. with a deformation rate of $\epsilon=6\times10^{-5}\ s^{-1}$ until a deformation of $\epsilon=1.6$ is reached, where $$\epsilon = \left|\ln\frac{h_o}{h}\right|$$

$$\epsilon = \frac{d\left|\ln\frac{h_o}{h}\right|}{dt}$$

$h_o$=original height of the workpiece,
h=height of the workpiece after deformation, and
t=time in seconds.

2. The method as claimed in claim 1, wherein the alloy has the composition below:

Ni=76 atom-%,
Al=18 atom-%,
Si=5.55 atom-%,
B=0.45 atom-%.

3. The method as claimed in claim 1, wherein the workpiece has the form of a gas turbine blade after the isothermal deformation.

4. The method as claimed in claim 1, wherein the workpiece is subjected, after the isothermal deformation, to a cold forming process with a decrease in cross-section of up to 40%.

5. The method as claimed in claim 4, wherein the cold forming process consists in a cold rolling.

* * * * *